US010211014B2

(12) United States Patent
Kim

(10) Patent No.: US 10,211,014 B2
(45) Date of Patent: Feb. 19, 2019

(54) ELECTRICAL CONNECTOR

(71) Applicant: SAMSUNG SDI CO., LTD., Yongin-si, Gyeonggi-do (KR)

(72) Inventor: Duk-Jung Kim, Yongin-si (KR)

(73) Assignee: Samsung SDI Co., Ltd., Yongin-si, Gyeonggi-do (KR)

( * ) Notice: Subject to any disclaimer, the term of this patent is extended or adjusted under 35 U.S.C. 154(b) by 0 days.

(21) Appl. No.: 15/618,752

(22) Filed: Jun. 9, 2017

(65) Prior Publication Data

US 2018/0047533 A1 Feb. 15, 2018

(30) Foreign Application Priority Data

Aug. 12, 2016 (KR) ..... 10-2016-0103143

(51) Int. Cl.

*H01H 39/00* (2006.01)
*H01H 85/20* (2006.01)
*H01H 85/02* (2006.01)
*H01H 37/76* (2006.01)

(52) U.S. Cl.

CPC ..... *H01H 39/002* (2013.01); *H01H 39/00* (2013.01); *H01H 85/0241* (2013.01); *H01H 85/20* (2013.01); *H01H 37/76* (2013.01); *H01H 2039/008* (2013.01)

(58) Field of Classification Search

CPC ..... H01H 37/76; H01H 37/761; H01H 39/00; H01H 39/002; H01H 39/006; H01H 2039/008; H01H 85/20; H01H 2085/466; H01H 85/0241

USPC ..... 337/157, 168, 401–403

See application file for complete search history.

(56) References Cited

U.S. PATENT DOCUMENTS 5,990,572 A * 11/1999 Yasukuni ..... H01H 39/006 180/271
6,295,930 B1 * 10/2001 Kume ..... H01H 39/006 102/202.5
6,388,554 B1 * 5/2002 Yamaguchi ..... H01H 39/00 337/157
6,418,005 B1 * 7/2002 Endo ..... H01H 39/00 337/168
6,445,563 B1 * 9/2002 Endo ..... H01H 85/0417 200/61.08
6,448,884 B1 * 9/2002 Yamaguchi ..... H01H 39/00 180/279
2002/0018331 A1 * 2/2002 Takahashi ..... H01H 39/00 361/103

(Continued)

FOREIGN PATENT DOCUMENTS

JP 2004-007919 A 1/2004
KR 10-2013-0010302 A 1/2013

*Primary Examiner* — Anatoly Vortman
*Assistant Examiner* — Jacob R Crum
(74) *Attorney, Agent, or Firm* — Lee & Morse, P.C.

(57) ABSTRACT

An electrical connector includes a lower body with terminal holes, an inflator between the terminal holes in the lower body, an upper body, and a cover, The upper body is on the lower body and includes an opening corresponding to at least one of the terminal holes and a pair of metal holders electrically connected to each other. The cover covers the upper body and includes an end portion coupled to the lower body. An inner surface of the cover faces a top surface of the upper body and includes a space that is separated from the top surface.

16 Claims, 11 Drawing Sheets

(56) References Cited

U.S. PATENT DOCUMENTS

| | | | | |
|---|---|---|---|---|
| 2013/0033843 | A1* | 2/2013 | Crotty, Jr. ..... | H05K 9/0032 361/807 |
| 2014/0062185 | A1* | 3/2014 | Nakamura ..... | B60L 3/0007 307/10.1 |

* cited by examiner

ELECTRICAL CONNECTOR

CROSS-REFERENCE TO RELATED APPLICATION

Korean Patent Application No. 10-2016-0103143, filed on Aug. 12, 2016, and entitled: "Electrical Connector," is incorporated by reference herein in its entirety.

BACKGROUND

1. Field

One or more embodiments described herein relate to an electrical connector.

2. Description of the Related Art

Electrical power from an alternator or a battery may be used to power the electrical systems and devices of a vehicle. For example, a starter motor for starting the engine of the vehicle may operate based on electrical power from a battery. Some of the electrical power generated by the alternator may be stored in the battery to allow the battery to store voltage equal to or greater than a predetermined level.

In vehicles of this type, the starting motor and alternator are always connected to the positive terminal of the battery through a wire. The negative terminal of the battery may be connected to ground. However, if a collision occurs while the battery is connected to the electrical and electronic devices of the vehicle, the battery may explode. For example, a spark may occur from the electrical power of the battery. As a result, fuel that has leaked from the vehicle fuel tank may ignite, thereby causing an explosion.

SUMMARY

In accordance with one or more embodiments, an electrical connector includes a lower body including terminal holes; a driver between the terminal holes in the lower body; an upper body on the lower body and including opening corresponding to at least one of the terminal holes and a pair of metal holders electrically connected to each other; and a cover to cover the upper body, wherein the cover includes an end portion coupled to the lower body, and wherein an inner surface of the cover facing a top surface of the upper body includes a space that is separated from the top surface.

The electrical connector may include at least one first protrusion outside the upper body and protruding toward an inner lateral wall of the cover, a first groove into which the first protrusion is inserted, the first groove in the inner lateral wall of the cover, and a second groove in the inner lateral wall of the cover exposed in the space. The first protrusion may include a bottom surface crossing a lateral surface of the upper body and a surface inclined relative to the lateral surface of the upper body, the inclined surface may correspond to the inner surface of the cover, and the bottom surface of the first protrusion may contact and may be coupled to one surface of the first groove. The first groove may form a closed curved line along the inner lateral wall of the cover. The first protrusion may extend along the first groove.

The electrical connector may include a second protrusion along an upper outer circumference of the lower body, wherein the second protrusion includes a bottom crossing a lateral surface of the lateral surface of the lower body and a surface inclined relative to the lateral surface of the lower body, and wherein the end portion of the cover is coupled to the second protrusion. The electrical connector may include a stopper along a lower outer circumference of the upper body, the stopper having a curved surface and the stopper protruding toward the inner lateral wall of the cover, and a third groove into which the stopper is inserted. A height of the space may be greater than an insertion length of a terminal passing through the terminal hole into the metal holder. The terminal may be an electrode terminal drawn out from a battery to supply power to a vehicle.

The electrical connector may include a fuse to connect metal holders adjacent to each other. The lower body may include a coupling part to fix the electrical connector, the coupling part may include a flange protruding from an outer side of the lower body, a plurality of coupling holes in the flange, and a plurality of coupling screws inserted into the coupling holes, respectively. The flange may be along an outer circumference of the lower body.

In accordance with one or more other embodiments, an electrical connector includes a lower body including terminal holes and a driver between the terminal holes; an upper body including a central portion which includes an opening corresponding to each terminal hole and a pair of metal holders electrically connected to each other and a peripheral portion including a first protrusion connected to the central portion with a predetermined interval therebetween and protruding outside, and a cover that covers the upper body and includes an end portion coupled to the first protrusion, wherein the lower body includes a second protrusion at an outer side of the lower body and protruding outside and wherein an end portion of the peripheral portion is coupled to the second protrusion.

A bottom surface of the central portion may contact a top surface of the lower body. The upper body may include a first spread space including an opening corresponding to the driver, and the lower body may includes a second spread space into which the driver is inserted and an opening facing the first spread space. A width of the first spread space or the second spread space may gradually increase closer to the opening of the first spread space or the second spread space.

The cover may include a first inner surface contacting an outer lateral surface of the upper body and a second inner surface spaced apart from the outer lateral surface of the upper body, and the peripheral portion may include a separation space between the peripheral portion and the central portion and a vent hole passing through a third spread space between the second inner surface and the peripheral portion. The first protrusion or the second protrusion may form a closed curved line along an outer circumference of the upper body or the lower body.

The electrical connector may include a coupling part along the outer circumference of the lower body, wherein the coupling part fixes the electrical connector and wherein the coupling part includes a flange protruding from an outer side of the lower body; a plurality of coupling holes in the flange, and a plurality of coupling screws inserted into the coupling holes, respectively.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
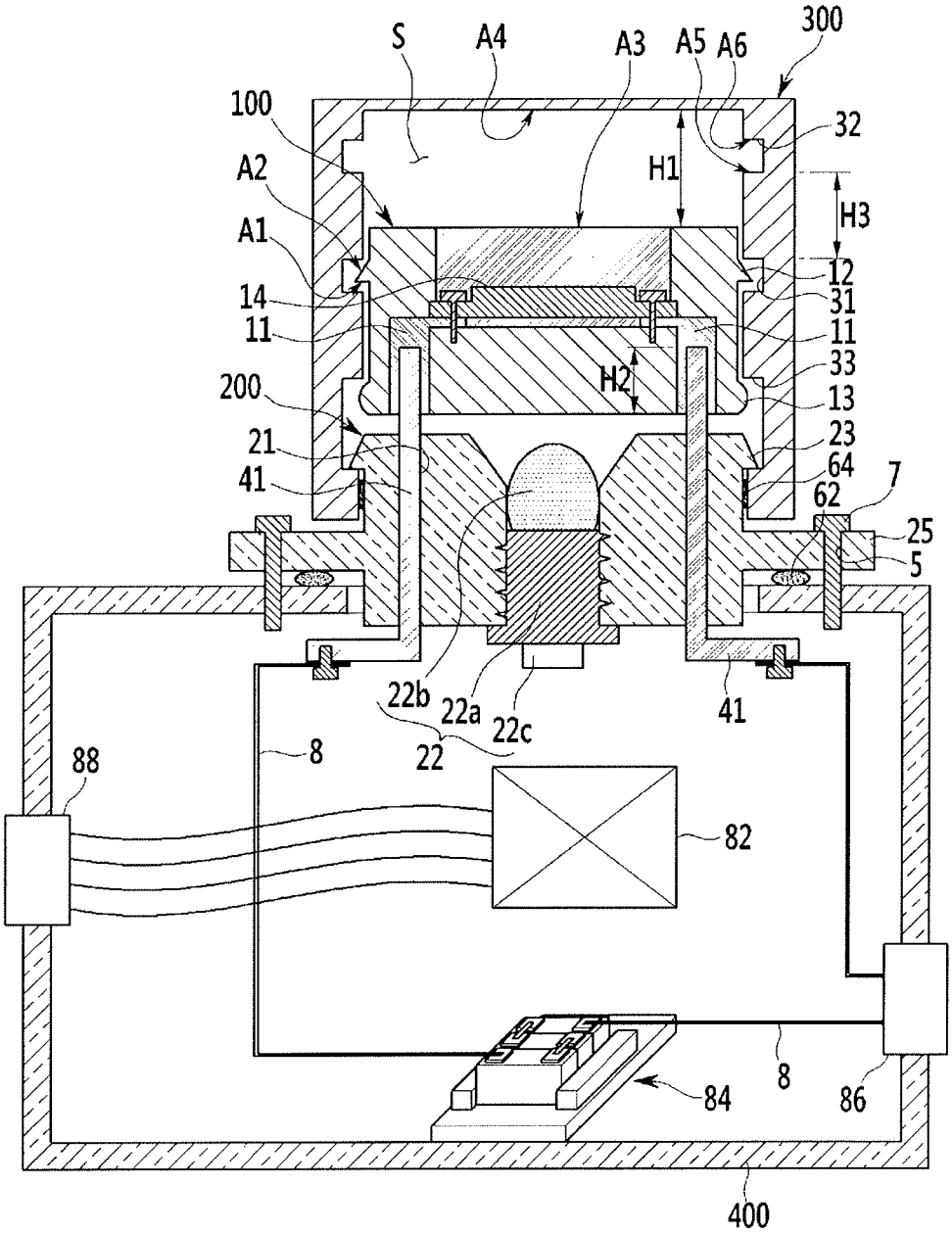
FIG. 1 illustrates an embodiment of an electrical connector.

Example embodiments will now be described with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments (or portions thereof) may be combined to form additional embodiments.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

FIG. 1 illustrates a cross-sectional view of an embodiment of an electrical connector. As shown in FIG. 1, the electrical connector includes a lower body 200, an upper body 100 on the lower body 200, and a cover 300 on the upper body 100 and covering the upper body 100 and the lower body 200.

The upper body 100 includes a pair of metal holders 11 electrically connected to each other. Each metal holder 11 is inserted into an insertion hole in the upper body 100. An opening may be provided at a portion of the metal holder 11 facing the lower body 200. The metal holder 11 may be in communication with a terminal hole 21 of the lower body 200.

A first protrusion 12, protruding from an outer side of the upper body toward an inner lateral surface of the cover 300, is formed at an outer side of the upper body 100. The first protrusion 12 includes a bottom surface A1 substantially perpendicular to an outer lateral surface of the upper body 100, and an inclined surface A2 inclined with respect to an outer lateral surface of the upper body 100. The inclined surface A2 may be inclined with respect to the outer lateral surface of the upper body 100 and may correspond to an inner surface A4 of the cover 300 facing a top surface A3 of the upper body 100.

In one exemplary embodiment, when the first protrusion 12 has an inclined surface, the first protrusion 12 is caught by a first groove 31 formed in an inner wall of the cover 300 to not be able to move in a direction of the lower body 200. Further, when a force (or pressure) toward an upper portion of the upper body 100 from a lower portion thereof of over a predetermined level is applied to the first protrusion 12, the first protrusion 12 is separated from the first groove 31, and the upper body 100 may move in a direction of the inner surface A4 of the cover 300.

The upper body 100 may include a stopper formed along a lower outer circumference of the upper body 100. The stopper 13 protrudes toward a lateral wall of the cover 300 and may have a curved surface.

The metal holder 11 may be electrically connected to an inner portion of a connector and may be electrically connected to an adjacent metal holder 11. The adjacent metal holders 11 may be connected by a fuse 14. Opposite ends of the fuse 14 may be electrically connected to the metal holder 11. The ends of the fuse 14 may be connected to the metal holders 11, respectively, for example, by welding, a metal screw, or another fastener or connector.

When an overcurrent flows through the fuse 14 due to abnormal operation of the battery pack, the fuse 14 is easily broken to block the flow of current, thereby preventing fire, explosion, or other harmful consequences.

The metal holder 11 may be electrically connected to an electronic device (e.g., a starting device, a heater, a cooler, etc.) that receives power from an apparatus, in which the electrical connector according to the present embodiment is installed.

The lower body 200 is between a pair of the terminal holes 21 and includes a driver 22 inserted and installed in a center of the lower body 200. The terminal hole 21 corresponds to the metal holder 11. The lower body 200 includes a second protrusion 23 formed along an upper outer circumference of the lower body 200. The second protrusion 23 includes a bottom surface crossing an outer lateral surface of the lower body 200 and an inclined surface inclined thereto. The first and second protrusions 12 and 23 may have the same cross-section.

The lower body 200 includes a coupling part 25 for fixing the electrical connector according to the exemplary embodiment. The coupling part 25 is at an outer side of the lower body 200 and may be a flange protruding outside the lower body 200. The coupling part 25 may, for example, surround the lower outer circumference of the lower body 200. The coupling part 25 may be partially formed in an outer circumference of the lower body 200. The coupling part 25 may include a plurality of coupling holes 5. Coupling screws 7 may be inserted into respective ones of the coupling holes 5 for coupling a device in which the electrical connector is installed, for example, to a battery pack 400.

When the electrical connector is coupled to the battery pack 400 through the coupling part 25, a first sealant 62 is between the coupling part 25 and the battery pack 400. Then, the coupling part 25 and the battery pack 400 may be coupled.

The first sealant may have an O-ring shape, a D-ring shape, or another ring shape, and may include a sealing surface with protrusions and depressions. The first sealant may include, for example, a superelastic material, e.g., silicon rubber, an elastomer, and ethylene propylene rubber (EPR, EPDM). In the case that the battery pack is exposed in the atmosphere and is not sealed (e.g., is a waterproof type), the first sealant may be omitted.

A terminal 41 of the device, in which the electrical connector according to the present embodiment is installed, passes through the terminal hole 21. The terminal 41 may be, for example, an electrode terminal of the battery pack 400.

Threads are formed on the driver 22. In this embodiment, the driver 22 includes a coupling part 22*a* screw-coupled to the lower body, a gas storage 22*b* on the coupling part 22*a*, and a squib connector 22*c*. When an ignition signal is transmitted to the squib connector 22*c* of the driver 22, gunpowder stored in the coupling part 22*a* explodes to eject gas from the gas storage 22*b*. Explosion pressure generated by the explosion pushes and moves the upper body 100.

When the upper body 100 moves, the metal holder 11 of the upper body 100 is separated from the terminal 41 that passes through the lower body 200 and is inserted into the mental holder 11. Also, the electrical connection between the metal holder 11 and the terminal 41 is disconnected. As a result, power to electronic devices connected to the terminal 41 is blocked.

Accordingly, the driver 22 is preferably inserted into a central portion of the lower body 200 so that the explosion pressure of the driver 22 may uniformly propagate to the upper body 100. When the driver 22 is not installed at the central portion of the lower body 200, a maximum explosion pressure may be applied to a portion that is not the central portion of the upper body 100. Thus, the upper body 100 may move in a tilted manner. As a result, the upper body 100 may not move smoothly move, and thus the metal holder 11 of the upper body 100 may not be completely separated from the terminal 41.

The cover 300 covers the upper body 100 and a lower portion thereof is coupled to the lower body 200. A receiving space is inside the cover 300. An upper portion of the lower body 200 and the upper body 100 may be in the receiving space.

The top surface A3 of the upper body 100 may face the inner surface A4 of the cover 300 face and may be spaced apart. An empty upper space S is on the top surface A3 of the upper body 100.

When the driver 22 explodes, the upper space S receives the moving upper body 100. For example, when the driver 22 explodes, the upper body 100 moves into the space S between the upper body 100 and the inner surface A4 of the cover 300, as a result of the explosion pressure of the driver 22. Accordingly, a height H1 of the space S into which the upper body 100 moves and is positioned may be longer than a length H2 of the terminal 41 that passes through the terminal hole and is inserted into the metal holder 11.

When the driver 22 explodes, the upper body 100 moves into upper space S. The movement distance of the upper body 100 may be much longer than the length H2, of a portion of which the terminal is inserted into the metal holder 11, in order to allow the metal holder 11 to be completely separated from the terminal for achieving electrical connection disconnection. Accordingly, the height H1 of the space S may provide a distance in which the upper body 100 may be completely separated from the metal holder 11 after the driver 22 explodes.

The first groove 31, a second groove 32, and a third groove 33 are in an inner lateral wall of the cover 300. The first groove 31 is at a position corresponding to the first protrusion 12. The second groove 32 is exposed in the upper space S. The third groove 33 is between a lower end portion of the cover 300 and the first groove 31.

The distance H3 between the first groove 31 and the second groove 32 may be greater than the length H2 of a portion of the terminal inserted into the metal holder 11. As a result, the metal holder 11 of the upper body 100 and the terminal 41 are not again electrically connected to each other but maintain electrical separation from each other after the driver 22 explodes and the upper body 100 moves.

Each of the first groove 31 and the second groove 32 may include a first surface A5 parallel to a second surface A6. The second surface A6 may be closer to the inner surface A4 of the cover 300 than the first surface A5. The first protrusion 12 is coupled to the first groove 31. The bottom surface A1 of the first protrusion 12 may be coupled to contact the first surface A5.

The first groove 31, the second groove 32, and the third groove 33 may form a closed curved line along the inner lateral wall of the cover 300. The first protrusion 12 may be formed, for example, along the first groove 31 and the outer circumference of the upper body 100 to have the closed curved line. A plurality of first protrusions 12 may be disposed at predetermined intervals.

The stopper 13 of the upper body 100 is coupled to the third groove 33. The stopper 13 may have a curved surface. The stopper 13 and one surface of the third groove 33 may be coupled in a line contact state. Accordingly, when force is applied to the stopper 13, the stopper 13 may be easily separated from the third groove 33, even by a relatively small force. Like the first protrusion 12, the stopper 13 may extend, for example, along the third groove 33. A plurality of stoppers 13 may be disposed at predetermined intervals.

The second protrusion 23 of the lower body 200 maybe coupled to the third groove 33, and in this case, the third groove 33 may be disposed to be spaced apart from the stopper 13.

A second sealant 64 may be between the lower end portion of the cover 300 and the lower body 200. The second sealant 64 may include the same material as the first sealant and may have the same shape as the first sealant. The second sealant 64 may seal the inner space of the cover 300 to prevent gas ejected inside the cover 300 from leaking outside. Further, the second sealant 64 may prevent the metal holder 11 and the terminal 41 from being exposed to external air and thus corroding.

The electrical connector according to the present exemplary embodiment may be connected to the battery pack 400. The battery pack 400 includes a housing 40 having an inner receiving space, a battery management system 82 installed in the housing, a battery unit 84, a high voltage connection portion 86, a low voltage connection portion 88, and a pair of terminals 41. The pair of terminals 41 may be electrically connected to positive and negative electrodes of the battery unit 84. The positive or negative electrode may be connected to the terminal 41 through the high voltage connection portion 86. The high voltage connection portion 86 may include a switch to intercept current. Electrical connection in the battery pack 400 may be implemented by a metal wire 8.

The battery management system 82 may be electrically connected to the low voltage connection portion 88 and may measure voltage, current, and/or temperature and a normal signal of the battery unit 84, in order to control charging and discharging of the battery unit 84 at a predetermined level.

In the electrical connector in FIG. 1, some of the lower body 200 is inserted and installed, for example, in the opening in the housing 40. The lower body 200 may be installed at the outer lateral surface of the housing 40. The terminal 41 may pass through the housing 40 to protrude to the outside.

When the electrical connector of the present embodiment is installed in the battery of the vehicle, a power source of the vehicle is automatically blocked by a collision signal, thereby preventing secondary accidents.

Figure 2:
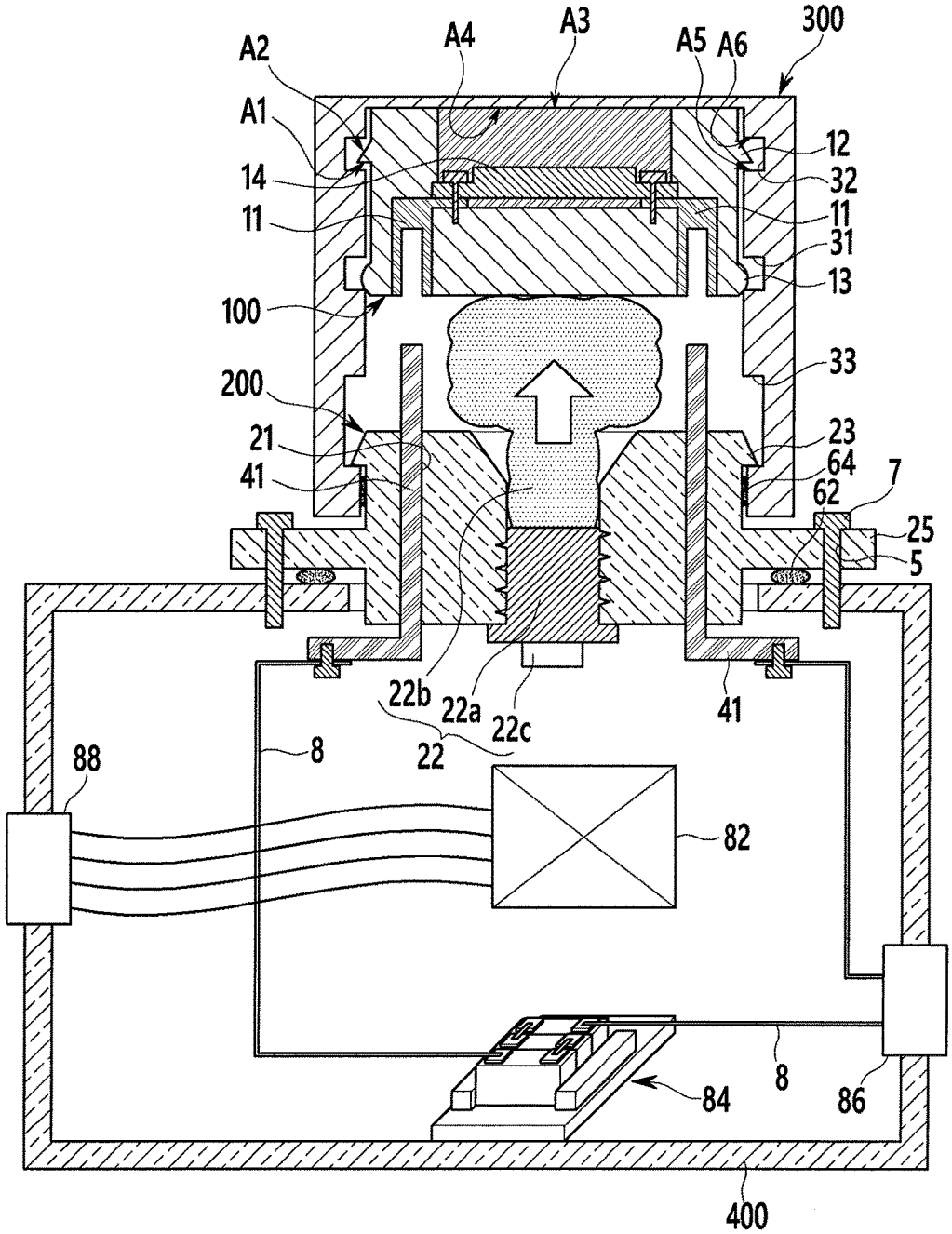
FIG. 2 illustrates the electrical connector after a driver explodes.

FIG. 2 illustrates a cross-sectional view of the electrical connector in FIG. 1 after the driver of the electrical connector explodes. When a vehicle collision occurs, an ignition signal is transmitted to the squib connector 22*c* of the driver 22 and the driver 22 explodes. The ignition signal may be transmitted, for example, from the battery management system or an airbag control unit (ACU) of the vehicle.

Referring to FIG. 2, when the driver 22 explodes, the metal holder 11 on the driver 22 is separated from the terminal 41 due to the pressure of the gas ejected from the driver 22. As a result, the power from the battery pack 400 is prevented from being transmitted to the electronic devices.

According to the present exemplary embodiment, even after the metal holder 11 is separated from the terminal 41, a predetermined distance between the terminal 41 and the metal holder 11 is maintained and the upper body 100 is received inside the cover 300. Thus, re-establishing electrical connection between the metal holder 11 and the terminal 41 may be prevented. Further, the explosion pressure of the driver may be blocked by the cover, to thereby prevent the pressure from leaking outside to other parts of the vehicle. Blocking propagation of the pressure to the outside may therefore prevent breakage of and gas leakage from the vehicle.

Figure 3:
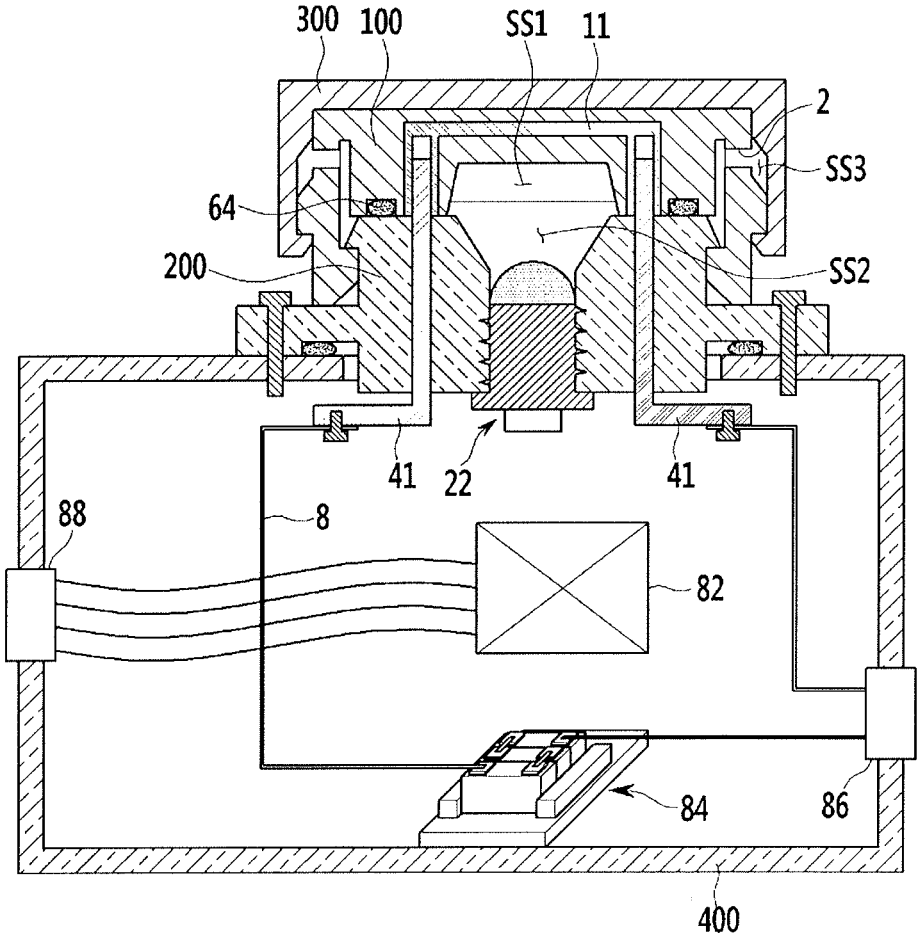
FIG. 3 illustrates another embodiment of an electrical connector.
Figure 4:
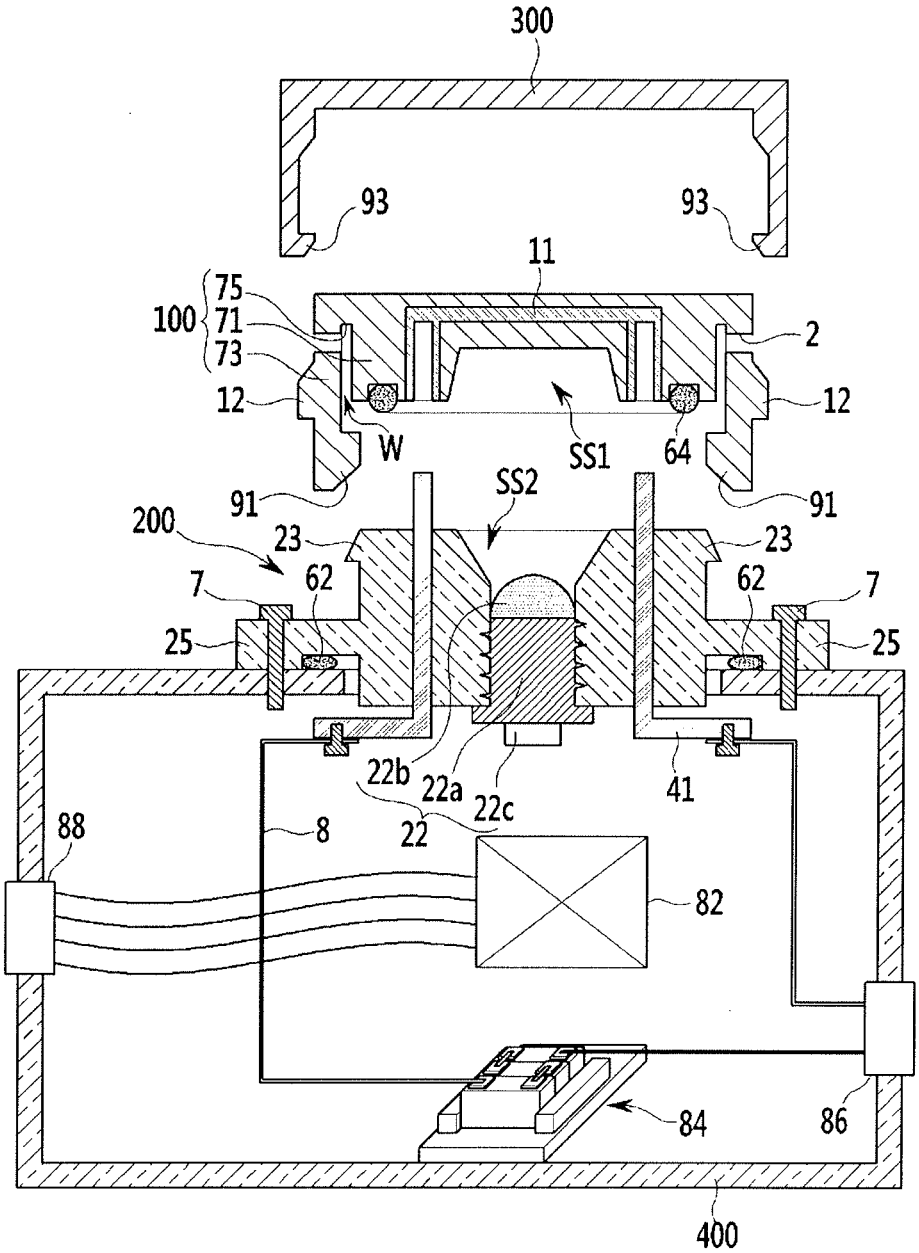
FIG. 4 illustrates an exploded view of the electrical connector in FIG. 3.

FIG. 3 illustrates a cross-sectional view of another embodiment of an electrical connector, and FIG. 4 illustrates an exploded view of this electrical connector. The electrical connector in FIG. 3 may be similar to the electrical connector in FIG. 1, except as follows.

Referring to FIGS. 3 and 4, the electrical connector includes a lower body 200, an upper body 100 on the lower body 200, and a cover 300 on the upper body 100 and covering the upper body 100 and the lower body 200. The upper body 100 includes a central portion 71 and a peripheral portion 73. The central portion 71 includes a pair of metal holders 11 electrically connected to each other. The peripheral portion 73 surrounds the central portion 71. A spacer 75 may be between the peripheral portion 73 and the central portion 71. The peripheral portion 73 is spaced apart from the outside of the central portion 71 by a predetermined interval. Thus, a separation space W may be between the peripheral portion 73 and the central portion 71.

The pair of metal holders 1 are inserted into the central portion 71, and the metal holders 11 are electrically connected to each other. A first spread space SS1 opened toward the lower body 200 is between the metal holders 11. The width of the first spread space SS1 may increase closer to the lower body 200.

The peripheral portion 73 extends to an upper portion of the outside of the lower body 200. The peripheral portion 73 may include a first protrusion 12 protruding toward a lateral wall of the cover 300. A first catching protrusion 91 protruding toward the outside of lower body 200 may be at an end portion of the peripheral portion 73. Further, a vent hole 2 may pass through the peripheral portion 73. The vent hole 2 is between the spacer 75 and the first protrusion 12. When the peripheral portion 73 is spaced apart from the central portion 71 and its end portion is not fixed by coupling, it may freely deform by a predetermined force.

A second protrusion 23 is at an upper outer side of the lower body 200. A coupling part 25 is at a lower portion of the lower body 200. The first catching protrusion 91 of the upper body 100 engages the second protrusion 23.

An driver 22 is inserted into a central portion of the lower body 200. The driver 22 may be fastened to the lower body 200, e.g., the driver 22 may be screwed to the lower body 200 by threads on a coupling part 22*a* of the driver 22. The lower body 200 includes the second spread space SS2 facing the first spread space SS1. A gas storage 22*b* of the driver 22 is in the second spread space SS2. The width of the second spread space SS2 may increase closer to the first spread space SS1 from the gas storage 22*b*. The second spread space SS2 forms a closed and sealed space, while communicating with the first spread space SS1.

The cover 300 covers the upper body 100, a second catching protrusion 93 protruding toward a lateral wall of the upper body 100 is at an end portion of the cover 300, and the second catching protrusion 93 engages the first protrusion 12 of the upper body 100. The cover 300 includes a first inner surface contacting an outer lateral surface including a top surface of the upper body 100, and a second inner surface spaced apart from the outer lateral surface of the upper body 100. Accordingly, a third spread space SS3 is between the second inner surface and the upper body 100. The second inner surface may be part of the peripheral portion 73 that is thinner than other portions. The vent hole 2 of the peripheral portion 73 communicates with the separation space W and the third spread space SS3.

Figure 5:
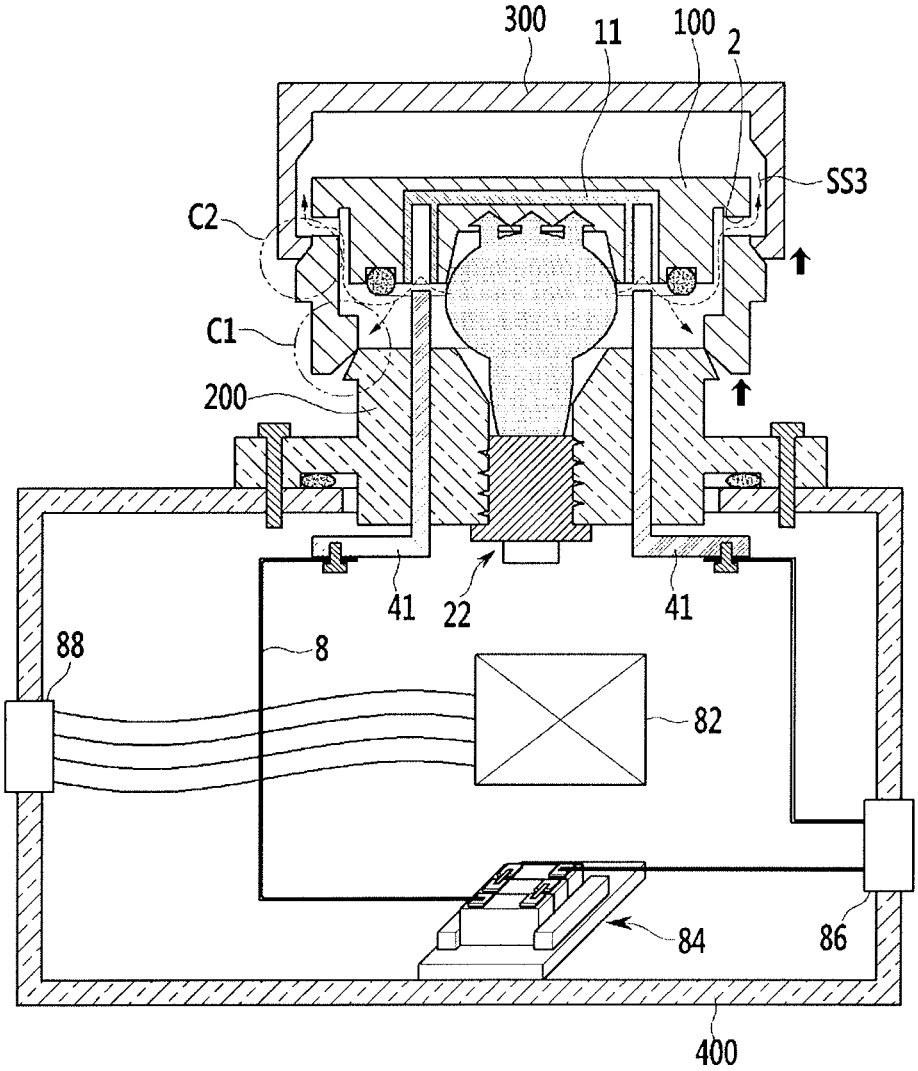
FIG. 5 illustrates the electrical connector in FIG. 3 after a driver explodes.

FIG. 5 illustrates a cross-sectional view of the electrical connector after the driver of the electrical connector in FIG. 3 explodes. When a vehicle collision occurs, an ignition signal is transmitted to the driver. As a result, the driver explodes.

Referring to FIG. 5, when the driver explodes, gas ejected from the driver presses the upper body 100 through the second spread space and the first spread space. When the explosion occurs, the ejected gas presses the bottom surface of the upper body 100. As a result, the upper body 100 is separated from the terminal.

For example, the gas moves (refer to the arrows) to the separation space W (e.g., see FIG. 4) between the peripheral portion 73 and the central portion through a gap between the upper body 100 and the lower body 200. The gas then moves to the third spread space SS3 through the vent hole 2. After discharging through the vent hole 2, the gas presses the cover 300 through the third spread space SS3 to weaken coupling force of the coupling portion C2 between the second catching protrusion 93 and the first protrusion 12. As a result, the second catching protrusion 93 is separated from the first protrusion 12.

When the second catching protrusion 93 is separated from the first protrusion 12, the coupling force of the coupling portion C1 between the first catching protrusion 91 and the second protrusion 23 weakens. As a result, the first catching protrusion 91 is easily separated from the second protrusion 23 by force of the gas pressing the peripheral portion 73. Accordingly, the cover 300 is completely separated from the upper body 100. Also, the upper body 100 is separated from the terminal 41, thereby blocking the power supply supplied to the electronic devices from the battery pack 400.

Unlike the electrical connector of FIGS. 1 and 2, in the electrical connector of FIGS. 3 to 5, the cover 300 as well as the upper body 100 is completely separated from the lower body 200. Accordingly, a separated state inside the electrical connector may be directly checked.

Figure 6:
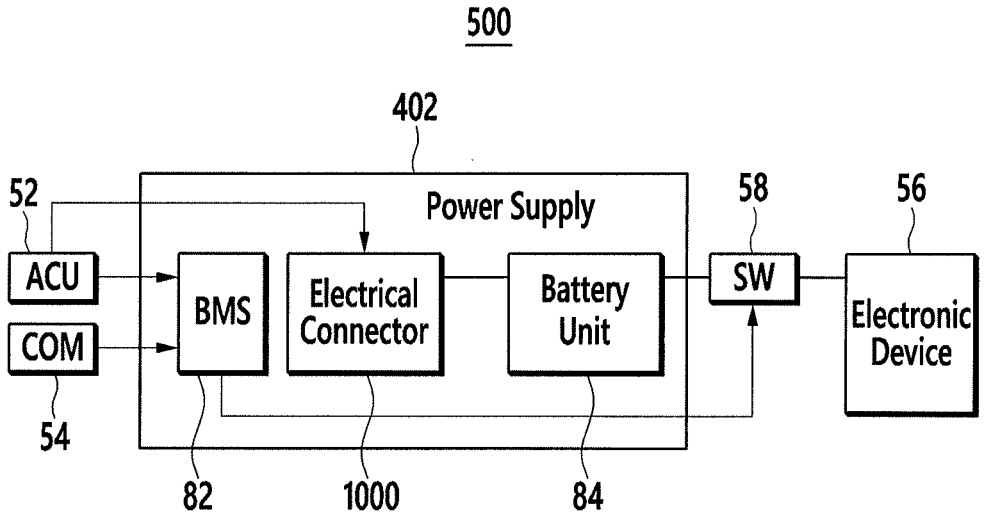
FIG. 6 illustrates an embodiment of a safety apparatus system for a vehicle.
Figure 7:
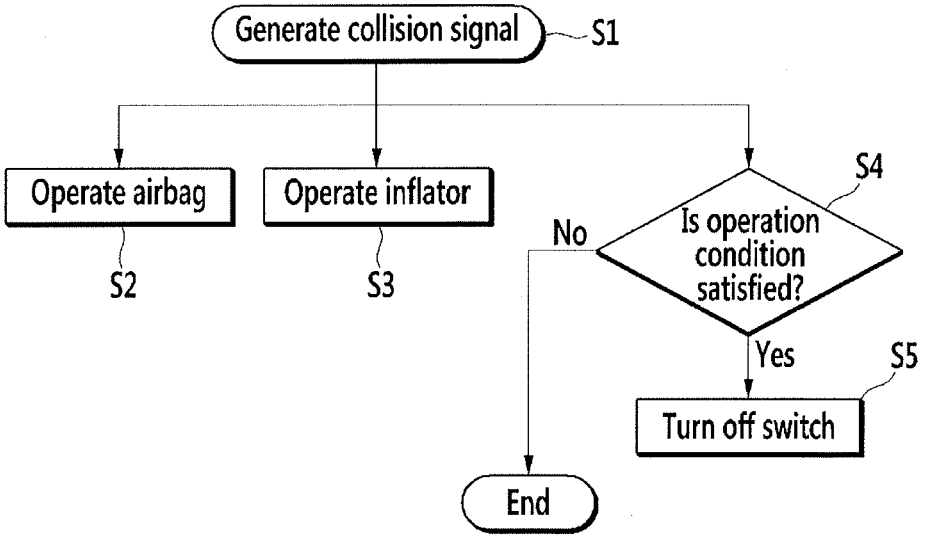
FIGS. 7 and 8 respectively illustrate an embodiment of an operation flowchart of the safety apparatus system.
Figure 8:
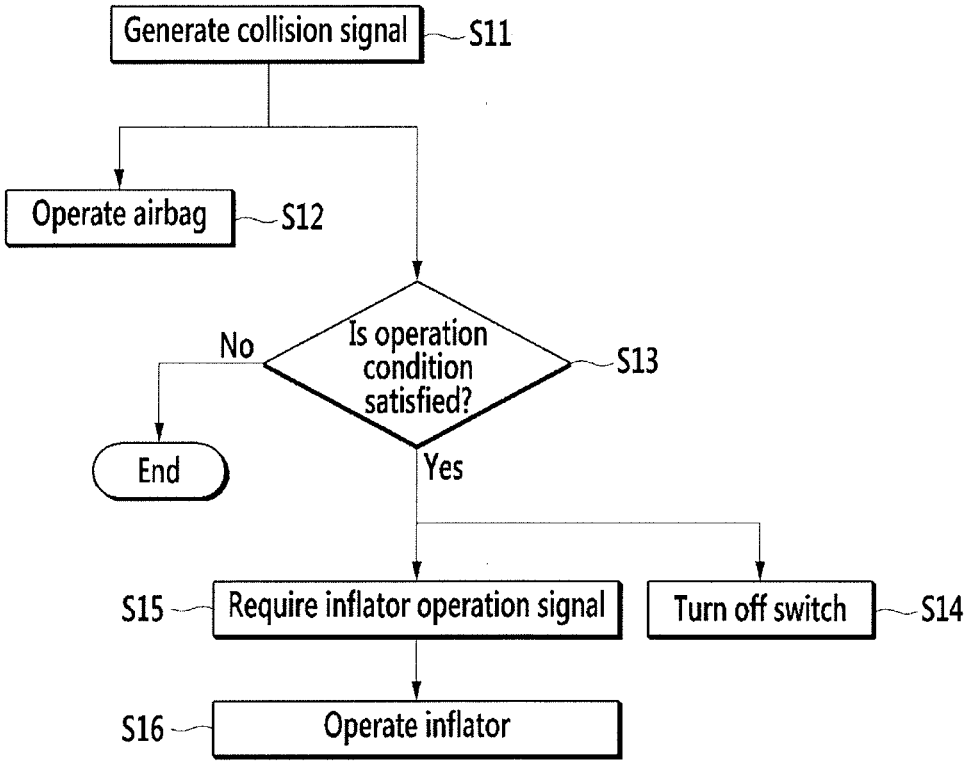

FIG. 6 illustrates an embodiment of a safety apparatus system 500 for a vehicle which may include the electrical connector according any of the aforementioned embodiments. FIGS. 7 and 8 respectively illustrate an embodiment of an operation flowchart of the safety apparatus system in FIG. 6.

Referring to FIG. 6, the safety apparatus system 500 includes an airbag control unit (ACU) 52, a power supply 402, a communication portion (COM) 54, and an electronic device 56. The ACU 52 outputs an inflation signal (IS) for inflating the airbag depending, for example, on a signal from a collision sensor of the vehicle.

The power supply 402 includes a battery management system (BMS) 82, a battery pack including a battery unit 84, and an electrical connector 1000. The battery unit 84 may include a plurality of unit cells. Each unit cell may be a lithium cell or another type of battery cell.

An output of the battery unit 84 is transformed, by an inverter or converter, to a voltage for output, for example, to the electronic device 56. The battery unit 84 may be connected to the electronic device 56 through a switch (SW) 58 connected to the high voltage connection portion. The electronic device 56 may include one or more electronic devices (e.g., a starting device for starting an engine, a heater, an air conditioner, etc.) of the vehicle.

The battery management system 82 measures voltage, current, and/or temperature and a normal signal of the battery unit 84 in order to control charging and discharging of the battery unit 84 at a predetermined level. Accordingly, when an abnormal signal such as an over-discharge, overcharge, overheat, or collision signal occurs, the battery management system 82 turns off the switch 58 to stop charging or discharging the battery unit 84.

The electrical connector 1000 may be connected to the ACU 52 and, for example, may be the electrical connector in FIG. 1 or 3. The communication portion 54 may be, for example, a controller area network (CAN) module that communicates with the ACU 52 and the battery management system 82. When a vehicle in which the safety apparatus system is installed collides, the safety apparatus system immediately blocks the power supply.

Referring to FIGS. 6 and 7, an embodiment of an operation method of the safety apparatus system 500 includes generating a collision signal when a vehicle collides (S1), operating an airbag (S2), operating a driver (S3), determining whether an operation condition is satisfied (S4), and turning off a switch (S5).

In operation S1, the collision signal is generated when the vehicle collides. The collision signal is measured by a collision sensor and is input to the ACU 52. The ACU 52 generates an airbag operation signal based on the collision signal.

In operation S2, the airbag operates. For example, an airbag operation device receives the airbag operation signal from the ACU 52 and then inflates the airbag.

In operation S3, the driver of the electrical connector 1000 is operated. For example, a driver operation signal (e.g., ignition signal IS) of the driver is input to the inflator from the ACU 52 to cause the driver to explode. The ignition signal IS may correspond, for example, to a signal for providing current for causing gunpowder of the driver to explode or for providing current that is directly applied to the driver through a wire to ignite the driver.

When the driver 22 explodes, pressure from the explosion (e.g., as in FIG. 2 or 5) causes the metal holder 11 to separate from the terminal 41. As a result, the metal holder 11 electrically disconnects from the terminal 41, to thereby prevent the occurrence of secondary accidents.

In operation S4, a determination is made as to whether the operation condition is satisfied. For example, the battery management system 82 determines whether the signal inputted from the ACU 52 is a collision signal. The collision signal may be transmitted through the communication portion 54.

In operation S5, the switch may be turned off. Turning off the switch may be performed when the condition in operation S4 is satisfied. The operation condition is satisfied, for example, when the signal input to the battery management system 82 corresponds to the collision signal.

When the operation condition is satisfied, the battery management system 82 generates the switch operation signal based on the collision signal to turn off the switch. As a result, the battery unit 84 is electrically disconnected from the electronic device 56. When the operation condition is not satisfied, the battery management system 82 does not generate the operation signal of the switch. In this case, power is supplied to the electronic device without interruption.

The safety apparatus system of FIG. 6 may be operated, for example, according to a method embodiment of FIG. 8. Referring to FIGS. 6 and 8, the operation method of the safety apparatus system includes generating a collision signal when a vehicle collides (S11), operating an airbag (S12), determining whether an operation condition is satisfied (S13), turning off a switch (S14), requiring a driver operation signal (S15), and operating a driver (S16).

In operation S11, the collision signal is generated when the vehicle collides. The collision signal is measured by a collision sensor and is input to the ACU 52. Then, the ACU 52 generates an airbag operation signal based on the collision signal.

In operation S12, the airbag is operated. For example, an airbag operation device receives the airbag operation signal from the ACU 52 and then inflates the airbag.

In operation S13, a determination is made as to whether the operation condition is satisfied. The battery management system 82 determines whether the signal input from the ACU 52 is a collision signal. The collision signal may be transmitted through the communication portion 54.

In operation S14, the switch may be turned off when the condition in operation S13 is satisfied. The operation condition may be satisfied when the signal input to the battery management system corresponds to the collision signal.

When the operation condition is satisfied, the battery management system 82 generates the switch operation signal based on the collision signal to turn off the switch. As a result, the battery unit 84 is electrically disconnected from the electronic device 56.

In operation S15, the driver operation signal of the electrical connector 1000 is generated when the condition in operation S13 is satisfied. The operation condition may be satisfied when the signal input to the battery management system corresponds to the collision signal. When the operation condition is satisfied, the battery management system 82 controls the ACU 52 to generate an driver operation signal. This is because the driver of the electrical connector 1000 is connected to the ACU 52.

In operation S16, the driver is operated when an operation signal (e.g., a driver operation signal for igniting the driver) is input to the electrical connector from the ACU. As a result, the driver explodes. When the driver 22 explodes, pressure from the explosion (e.g., as in FIG. 2 or 5) causes the metal holder 11 to separate from the terminal 41. As a result, the metal holder 11 is electrically disconnected from the terminal 41, thereby preventing the occurrence of the secondary accidents.

In operation S13, a determination is made as to whether the operation condition is satisfied. When the operation condition is not satisfied, the battery management system 82 does not turn off the switch and does not generate driver operation signals. As a result, power is supplied to the electronic device without interruption.

Figure 9:
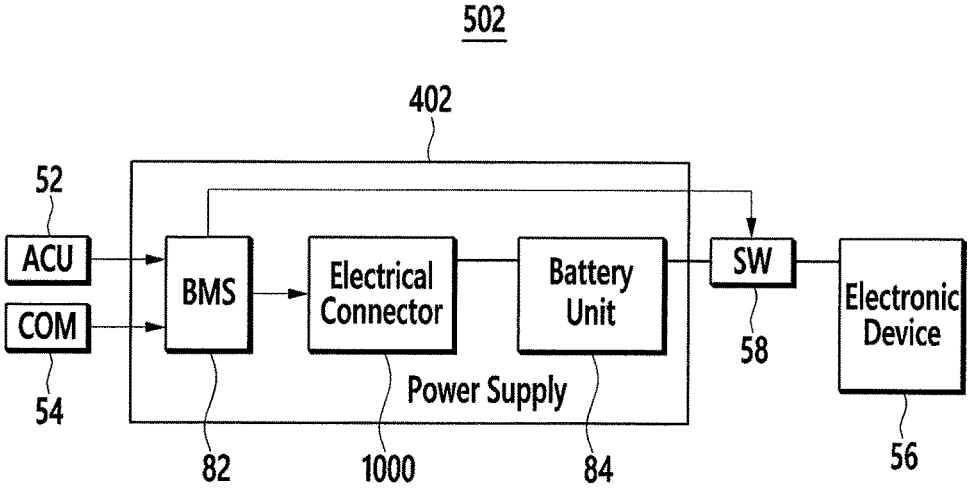
FIG. 9 illustrates another embodiment of a safety apparatus system of a vehicle.
Figure 10:
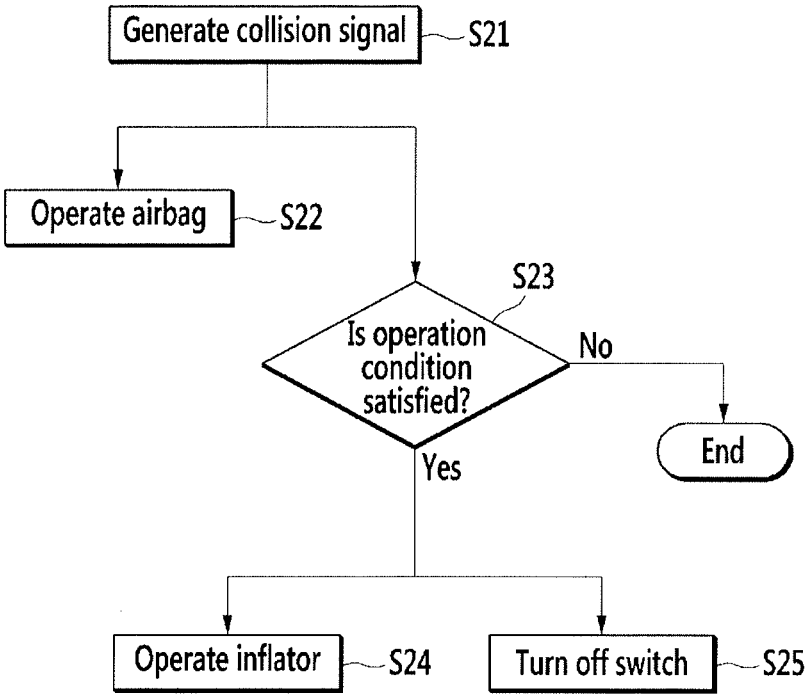
FIGS. 10 and 11 respectively illustrate an embodiment of an operation flowchart of the safety apparatus system in FIG. 9.
Figure 11:
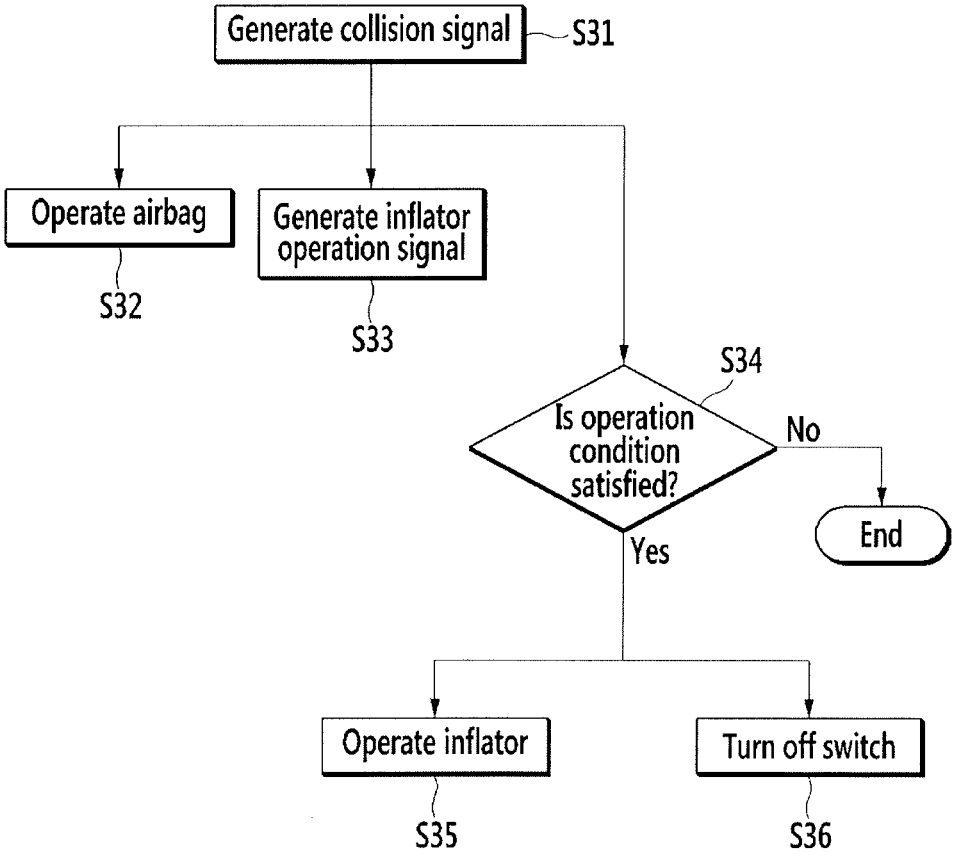

FIG. 9 illustrates another embodiment of a safety apparatus system 502 for a vehicle, which includes any of the aforementioned embodiments of the electrical connector. FIGS. 10 and 11 respectively illustrate an embodiment of an operation flowchart of the safety apparatus system in FIG. 9. The safety apparatus system 502 in FIG. 9 may be similar to that of FIG. 1, except for the following.

Referring to FIG. 9, the safety apparatus system 502 includes an airbag control unit (ACU) 52, a communication portion (COM) 54, a power supply 402, and an electronic device 56. The power supply 402 includes a battery management system (BMS) 82, a battery pack including the battery unit 84, and an electrical connector 1000. The battery unit 84 is connected to electronic device 56 through a switch (SW) 58. The electrical connector 1000 may be connected to the battery management system 82.

Referring to FIGS. 9 and 10, an embodiment of an operation method of the safety apparatus system 502 according to another exemplary embodiment of the present invention includes generating a collision signal when a vehicle collides (S21), operating an airbag (S22), determining whether an operation condition is satisfied (S23), operating a driver of the electrical connector (S24), and operating a switch (S25).

In operation S21, the collision signal is generated when the vehicle collides. The collision signal is measured by a collision sensor and is input to the ACU 52. The ACU 52 generates an airbag operation signal based on the collision signal.

In operation S22, the airbag is operated. For example, an airbag operation device receives the airbag operation signal from the ACU 52 and then inflates the airbag.

In operation S23, a determination is made as to whether the operation condition is satisfied. The battery management system 82 determines whether the signal input from the ACU 52 is a collision signal. The collision signal may be transmitted through the communication portion 54.

In operation S24, the driver may be operated when the condition in operation S23 is satisfied. The operation condition is satisfied when the signal input to the battery management system corresponds to the collision signal. When the operation condition is satisfied, the battery management system 82 generates an operation signal (e.g., driver operation signal IS for igniting the driver) based on the collision signal. The operation signal is then transmitted to the driver 22.

When the driver 22 explodes based on the transmitted operation signal, for example, as shown in FIG. 2 or 5, the metal holder 11 is electrically disconnected from the terminal 41 as a result of pressure from the explosion. Thus, the occurrence of secondary accidents may be prevented.

In operation S25, the switch may be turned off when the operation condition is satisfied in operation S23. When operation condition is satisfied when the signal input to the battery management system corresponds to the collision signal. When the operation condition is satisfied, the battery management system 82 generates the switch operation signal, based on the collision signal, to turn off the switch. As a result, the battery unit 84 is electrically disconnected from the electronic device 56.

In operation S23, when the operation condition is not satisfied, the battery management system 82 does not turn off the switch or generate driver operation signals. As a result, power is supplied to the electronic device without interruption.

The safety apparatus system of FIG. 9 may be operated, for example, according to the method embodiment of FIG. 11. Referring to FIGS. 9 and 11, an operation method of the safety apparatus system 502 includes generating a collision signal when a vehicle collides (S31), operating an airbag (S32), generating a driver operation signal (S33), determining whether an operation condition is satisfied (S34), operating an electrical connector (S35), and turning off a switch (S36).

In operation S31, the collision signal is generated when the vehicle collides. The collision signal is measured by a collision sensor and is input to the ACU 52. Then, the ACU 52 generates an airbag operation signal based on the collision signal. Further, the ACU 52 generates the driver operation signal (S33).

In operation S32, the airbag is operated. For example, an airbag operation device receives the airbag operation signal from the ACU 52 and inflates the airbag.

In operation S34, a determination is made as to whether the operation condition is satisfied. The battery management system 82 receives the collision signal and the driver operation signal from the ACU 52, and then determines whether the collision signal is satisfied. The collision signal may be transmitted through the communication portion 54.

In operation S35, the driver of the electrical connector 1000 may be operated when the operation condition is satisfied in operation S34. The operation condition is satisfied when the signal input to the battery management system is the collision signal or the driver operation signal.

When the operation condition is satisfied, the battery management system 82 generates an operation signal (e.g., ignition signal IS of the driver) based on the collision signal. The operation signal is then transmitted to the driver 22. When the driver 22 explodes based on the transmitted operation signal, as shown in FIG. 2 or 5, the metal holder 11 is electrically disconnected from the terminal 41 as a result of the explosion pressure, thereby preventing the occurrence of secondary accidents.

In operation S36, the switch may be turned off when the operation condition is satisfied in operation S34. The operation condition is satisfied when the signal input to the battery management system corresponds to the collision signal.

When the operation condition is satisfied, the battery management system 82 generates the switch operation signal based on the collision signal to turn off the switch. As a result, the battery unit 84 is electrically disconnected from the electronic device 56.

In operation S34, a determination is made as to whether the operation condition is satisfied. When the operation condition is not satisfied, the battery management system 82 does not turn off the switch and does not generate driver operation signals. In this case, power is supplied to the electronic device without interruption.

In the exemplary embodiment of FIG. 11, the battery management system 82 simultaneously receives the collision signal and the driver operation signal from the ACU 52. When these two signals are simultaneously input to the battery management system 82, determination errors regarding the operation signal may be reduced.

For example, as shown in FIG. 6, when the electrical connector directly receives the driver operation signal from the ACU, the collision signal is input to the battery management system. When the ACU 52 does not generate the driver operation signal due to a failure or error, the driver of the electrical connector may not operate.

However, as shown in FIG. 11, by allowing the driver operation signal and the collision signal of the electrical connector to be simultaneously input to the battery management system, the battery management system may determine the existence of a collision even though only one of the two signals is input. As a result, the driver of the electrical connector may be operated.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods herein.

The BMS and other processing features of the disclosed embodiments may be implemented in logic which, for example, may include hardware, software, or both. When implemented at least partially in hardware, the BMS and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the BMS and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

Example embodiments have been disclosed herein, and although specific terms are employed, they are used and are to be interpreted in a generic and descriptive sense only and not for purpose of limitation. In some instances, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the embodiments set forth in the claims.

What is claimed is:

1. An electrical connector, comprising:

a lower body including terminal holes with terminals;

a driver between the terminal holes in the lower body;

an upper body on the lower body and including an opening corresponding to at least one of the terminal holes and a pair of metal holders electrically connected to the terminals; and a cover to cover the upper body, wherein the cover includes an end portion coupled to the lower body, at least one first protrusion outside the upper body and protruding toward an inner lateral wall of the cover; and a first groove into which the first protrusion is inserted, the first groove being in the inner lateral wall of the cover;

wherein:

an inner surface of the cover facing a top surface of the upper body includes a space that is separated from the top surface, wherein the driver is to apply a force to separate the upper body from the lower body to electrically disconnect at least one of the pair of metal holders and at least one of the terminals, the driver to apply the force based on a signal corresponding to a vehicle collision, and a second groove is in the inner lateral wall of the cover and is exposed in the space.

2. The electrical connector as claimed in claim 1, wherein:

the first protrusion includes a bottom surface crossing a lateral surface of the upper body and a surface inclined relative to the lateral surface of the upper body, the inclined surface corresponds to the inner surface of the cover, and the bottom surface of the first protrusion contacts and is coupled to one surface of the first groove.

3. The electrical connector as claimed in claim 1, wherein the first groove forms a closed curved line along the inner lateral wall of the cover.

4. The electrical connector as claimed in claim 3, wherein the first protrusion extends along the first groove.

5. The electrical connector as claimed in claim 1, further comprising:

a second protrusion along an upper outer circumference of the lower body, wherein the second protrusion includes a bottom crossing a lateral surface of the lower body and a surface inclined relative to the lateral surface of the lower body, and wherein the end portion of the cover is coupled to the second protrusion.

6. The electrical connector as claimed in claim 5, further comprising:

a stopper along a lower outer circumference of the upper body, the stopper having a curved surface and the stopper protruding toward the inner lateral wall of the cover, and a third groove into which the stopper is inserted.

7. The electrical connector as claimed in claim 1, wherein a height of the space is greater than an insertion length of one of the terminals passing through a corresponding one of the terminal holes corresponding to one of the metal holders.

8. The electrical connector as claimed in claim 7, wherein the one of the terminals is an electrode terminal drawn out from a battery to supply power to a vehicle.

9. The electrical connector as claimed in claim 1, further comprising:

a fuse to connect the metal holders adjacent to each other.

10. The electrical connector as claimed in claim 1, wherein:

the lower body includes a coupling part to fix the electrical connector, the coupling part includes a flange protruding from an outer side of the lower body, a plurality of coupling holes in the flange, and a plurality of coupling screws inserted into the coupling holes, respectively.

11. The electrical connector as claimed in claim 10, wherein the flange is along an outer circumference of the lower body.

12. An electrical connector, comprising:

a lower body including terminal holes with terminals and a driver between the terminal holes;

an upper body including a central portion which includes an opening corresponding to each terminal hole and a pair of metal holders electrically connected to the terminals and a peripheral portion including a first protrusion connected to the central portion with a predetermined interval therebetween and protruding outside, and a cover that covers the upper body and includes an end portion coupled to the first protrusion, wherein the lower body includes a second protrusion at an outer side of the lower body and protruding outside, wherein an end portion of the peripheral portion is coupled to the second protrusion, and wherein the driver is to apply a force to separate the upper body from the lower body to electrically disconnect at least one of the pair of metal holders and at least one of the terminals, the driver to apply the force based on a signal corresponding to a vehicle collision, wherein:

the upper body includes a first spread space including an opening corresponding to the driver, the lower body includes a second spread space into which the driver is inserted and an opening facing the first spread space, the cover includes a first inner surface contacting an outer lateral surface of the upper body and a second inner surface spaced apart from the outer lateral surface of the upper body, and the peripheral portion includes a separation space between the peripheral portion and the central portion and a vent hole passing through a third spread space between the second inner surface and the peripheral portion.

13. The electrical connector as claimed in claim 12, wherein a bottom surface of the central portion contacts a top surface of the lower body.

14. The electrical connector as claimed in claim 12, wherein a width of the first spread space or the second spread space gradually increases closer to the opening of the first spread space or the second spread space.

15. The electrical connector as claimed in claim 12, wherein the first protrusion or the second protrusion is located along an outer circumference of the upper body or the lower body.

16. The electrical connector as claimed in claim 12, further comprising:

a coupling part along an outer circumference of the lower body, wherein the coupling part fixes the electrical connector and wherein the coupling part includes a flange protruding from an outer side of the lower body;

a plurality of coupling holes in the flange, and a plurality of coupling screws inserted into the coupling holes, respectively.

* * * * *